US008145104B2

(12) United States Patent
Brown et al.

(10) Patent No.: US 8,145,104 B2
(45) Date of Patent: Mar. 27, 2012

(54) METERING SKIVE FOR A DEVELOPER ROLLER

(75) Inventors: Kenneth J. Brown, Penfield, NY (US); David S. Kepner, Bloomfield, NY (US)

(73) Assignee: Eastman Kodak Company, Rochester, NY (US)

( * ) Notice: Subject to any disclaimer, the term of this patent is extended or adjusted under 35 U.S.C. 154(b) by 644 days.

(21) Appl. No.: 12/339,580

(22) Filed: Dec. 19, 2008

(65) Prior Publication Data

US 2010/0158580 A1 Jun. 24, 2010

(51) Int. Cl.
*G03G 5/09* (2006.01)

(52) U.S. Cl. ..... 399/274

(58) Field of Classification Search ..... 399/274, 399/284

See application file for complete search history.

(56) References Cited

U.S. PATENT DOCUMENTS

| | | | | |
|---|---|---|---|---|
| 5,144,370 | A * | 9/1992 | Bares | 399/266 |
| 5,532,810 | A | 7/1996 | Cahill | |
| 5,659,865 | A | 8/1997 | Zarbo | |
| 6,029,039 | A | 2/2000 | Aslam et al. | |
| 6,104,000 | A | 8/2000 | Aslam et al. | |
| 6,469,757 | B1 | 10/2002 | Petruchik | |
| 6,564,030 | B2 | 5/2003 | Baughman et al. | |
| 6,678,496 | B1 | 1/2004 | Aslam et al. | |
| 6,690,899 | B2 | 2/2004 | Brown et al. | |
| 6,813,464 | B2 | 11/2004 | Amita et al. | |
| 7,024,153 | B2 | 4/2006 | Weiner et al. | |
| 7,043,187 | B2 | 5/2006 | Brown et al. | |

FOREIGN PATENT DOCUMENTS

| | | | |
|---|---|---|---|
| EP | 0 155 169 | A2 | 9/1985 |
| EP | 0 962 835 | A2 | 12/1999 |
| EP | 1 288 732 | A2 | 3/2003 |
| JP | 58 105265 | A | 6/1983 |

* cited by examiner

*Primary Examiner* — David Gray
*Assistant Examiner* — Gregory H Curran
(74) *Attorney, Agent, or Firm* — David A. Novais; Christopher J. White

(57) ABSTRACT

A metering skive for a developer roller which is adapted to shear and/or meter developer at a developer-skive interface while minimizing compression of the metered developer. The metering skive is adjustable to various shear angles and has a geometry which enables a portion of the developer flow to be sheared away toward a curved second surface of the metering skive while metering the developer flow in a manner which minimizes or reduces compression of the developer.

9 Claims, 5 Drawing Sheets

METERING SKIVE FOR A DEVELOPER ROLLER

FIELD OF THE INVENTION

The present invention relates to a metering skive for a developer roller which is adapted to shear or meter developer at a developer-skive interface while minimizing compression of the metered developer.

BACKGROUND OF THE INVENTION

In a two component development system, the ability to apply sufficient developer (toner+carrier) to develop a latent image on a photoconductor enables the creation of images with high fidelity and quality. In general practice, developer "Flow" is the common metric used to describe the amount of developer delivered to a toning zone per unit time. This is accomplished by lowering a gate into a developer stream, (2" wide) and collecting developer for a specified amount of time (0.5 Sec). This developer is then weighed and reported in units of gm/in/s. This has been correlated against certain imaging properties of the developer, such as toning contrast, background, etc.

Since the measurement of developer flow aggregates the effects of developer mass density and developer velocity, the developer flow measurement is also proportional to the product of independently measured developer bulk mass density and developer velocity. In a typical embodiment of a development station, developer is fed to a developer roller by way of a feed roller (Raw Flow) (RF). A mechanical doctor blade or metering skive is used to reduce flow variations in the developer flow along the length of the development roller to provide for metered flow (MF) on the surface of the developer roller.

The developer is a compressible powder, and control of the densification of the developer in the process of metering is beneficial for proper imaging. Excessive compression by a metering skive or doctor blade will cause the bulk density of the developer to approach its true density, causing failure as the developer forms 'sheets' when it reaches its maximum density and exits the development station, since developer cohesiveness increases with increasing bulk density. Therefore, control of the developer compression through the metering process is desirable.

SUMMARY OF THE INVENTION

The present invention provides for a metering skive which is adapted to meter the flow of developer onto a developer roller while minimizing and controlling compression of the metered developer flow.

More specifically, the present invention relates to a metering skive adapted to meter a flow of developer that is supplied onto a surface of a developer roller which comprises a first surface located on an exit side of the metering skive with respect to a direction of developer flow onto a surface of a developer roller; and a second surface located on an entrance side of the metering skive with respect to the direction of developer flow onto the surface of the developer roller, with the second surface being a curved surface. The metering skive is adjustable between at least a first position where the first surface is perpendicular to a tangent line which extends from the surface of the developer roller to define a 0 degree shear angle, a second position where the first surface is at an angle from the tangent line to define a 45 degree shear angle, and a third position where the first surface is parallel to the tangent line to define a 90 degree shear angle. The second curved surface defines a radius which is sized to hold a portion of developer that is sheared from the developer roller surface by the metering skive, such that the metering skive is adapted to meter the developer flow.

The present invention further relates to a development system that comprises a developer roller; a feed roller adapted to supply developer onto a surface of the developer roller; and a metering skive adapted to meter a flow of the developer that is supplied onto the surface of the developer roller. The metering skive comprises a first surface located on an exit side of the metering skive with respect to a direction of developer flow onto the surface of the developer roller; and a second surface located on an entrance side of the metering skive with respect to the direction of developer flow onto the surface of the developer roller, with the second surface being a curved surface. The metering skive is adjustable between at least a first position where the first surface is perpendicular to a tangent line which extends from the surface of the developer roller to define a 0 degree shear angle, a second position where the first surface is at an angle from the tangent line to define a 45 degree shear angle, and a third position where the first surface is parallel to the tangent line to define a 90 degree shear angle. The second curved surface defines a radius which is sized to hold a portion of developer that is sheared from the developer roller surface by the metering skive, such that the metering skive is adapted to meter the developer flow.

The present invention further relates to a method for metering developer on a developer roller which comprises locating a metering skive in proximity to a surface of a developer roller having developer supplied thereon so that a first surface of the metering skive is located at an exit end of the metering skive with respect to a direction of flow of developer, and a second curved surface of the metering skive is located on an entrance side of the metering skive with respect to the direction of flow of developer and is adapted to capture extra flow of the developer; and adjusting the metering skive to at least a first position where the first surface is perpendicular to a tangent line which extends from the surface of the developer roller to define a 0 degree shear angle, a second position where the first surface is at an angle from the tangent line to define a 45 degree shear angle, or a third position where the first surface is parallel to the tangent line to define a 90 degree shear angle; and metering the developer on the surface of the developer roller to provide for a metered flow.

The present invention further relates to a metering skive for metering developer on a developer roller which comprises a metering surface located at a developer-skive interface which is adapted to meter developer on a developer roller and shear away a portion of the developer that is not metered; and a curved surface that is adapted to capture the sheared away portion of the developer that is not metered.

The present invention further relates to a metering skive adapted to meter a flow of developer that is supplied onto a surface of a developer roller which comprises a first surface located on an exit side of the metering skive with respect to a direction of developer flow onto a surface of a developer roller; and a second surface located on an entrance side of the metering skive with respect to the direction of developer flow onto the surface of the developer roller, with the second surface being a curved surface. The metering skive is located at a position relative to the surface of the developer roller where the first surface of the metering skive is at an angle from the tangent line that defines a 45 degree shear angle; and the second curved surface defines a radius which is sized to hold a portion of developer that is sheared from the developer roller surface by the metering skive, such that the metering skive is adapted to meter the developer flow while minimizing compression of the metered developer on the surface of said developer roller.

In a feature of the present invention, developer compression induced by the metering process is reduced with a metering skive geometry that is adapted to promote shearing of the developer at a developer-skive interface, wherein the metering skive forms a pointed tip or edge at the developer-skive interface. Specifically, compression is minimized or reduced when the angle of a first surface of the metering skive is between 0 degrees and 90 degrees relative to the tangent line of the developer roller, preferably between 45 degrees and 90 degrees relative to the tangent of the developer roller, and more preferably 45 degrees. This allows for extra flow to be shed from the raw flow without effecting the compression of the raw flow, and also prevents any additional post metering compression of the metered flow. In a further feature of the present invention, the metering skive includes a second surface that has a curvature and a generous radius on an entrance side of the skive with respect to a direction of developer flow, to facilitate shedding and/or capture of the extra flow.

DETAILED DESCRIPTION OF THE INVENTION

Figure 1:
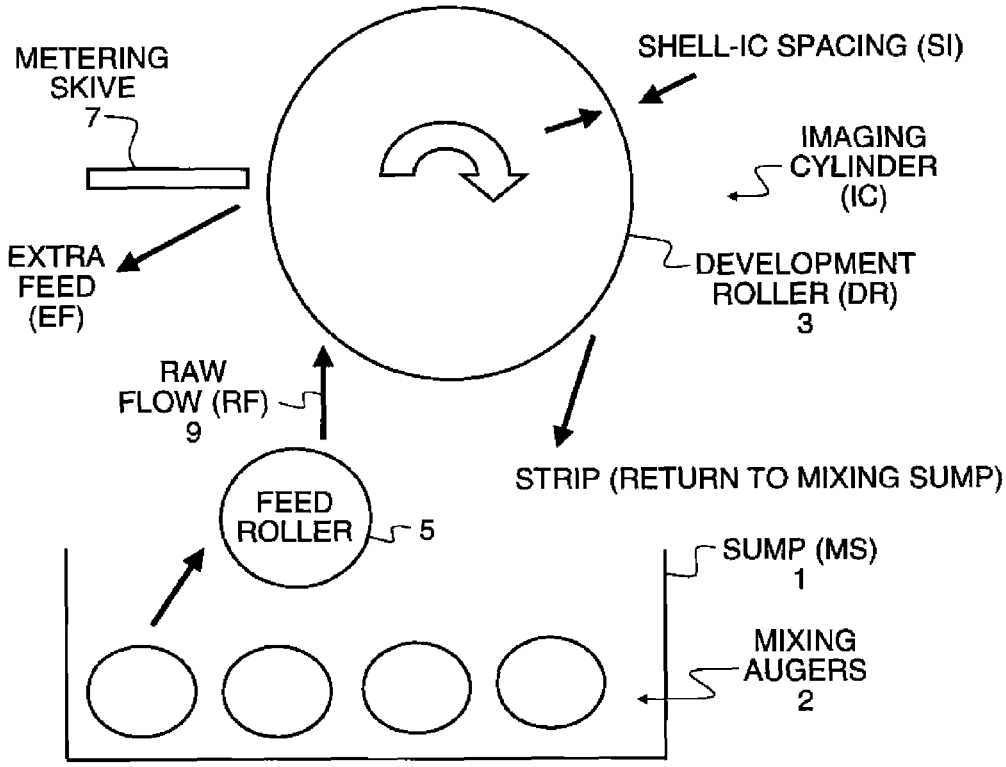
FIG. 1 is a schematic representation of a development station or development system.

Referring now to the drawings, wherein like reference numerals represent identical and/or corresponding parts throughout the several views, an embodiment of a development station or development system is shown in FIG. 1. In this embodiment, a 2-Component developer is replenished with new toner, thoroughly mixed in a mixing sump 1 having mixing augurs 2, and transported to a development or developer roller 3 by means of a rotating feed roller 5. Feed roller 5 is adapted to act as a buffer between turbulent flow in the mixing sump 1 and the more controlled, smooth flow necessary for the development process. A mechanical doctor blade or metering skive 7 is then used to further reduce flow variations in the developer flow along the length of the development roller 3. This necessitates that raw flow 9 (RF) (which is developer introduced onto the development roller 3 from the feed roller 5) is greater than metered flow (MF) (which is a desired final flow after the skiving process). The ratio between the raw flow and the metered flow is defined as the Overfeed Ratio (RF/MF). The difference between the RF and the MF is the undesired or Extra Flow (EF).

Figure 2:
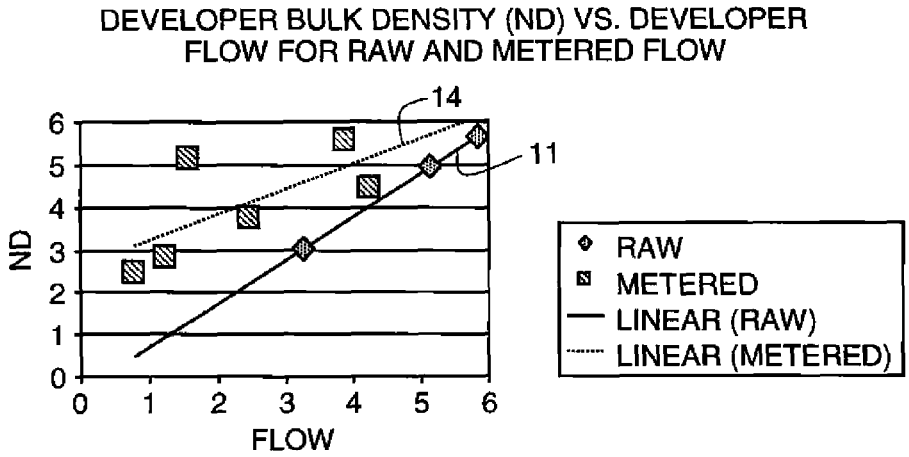
FIG. 2 is a graph of developer bulk density versus developer flow for raw developer flow and metered developer flow.

In known systems the metering skive may be provided at a fixed angle relative to the surface of the developer roller and/or may generally have a uniform thickness that is parallel to the surface of the developer roller and does not promote shearing. In these known systems, observations relative to the compression of the developer were made by comparing the bulk density of the unmetered (Raw) flow 11 as shown in FIG. 2, as compared to the metered flow 14. The data illustrated in FIG. 2 shows that the bulk density for the metered flow (see line 14 in FIG. 2) is always higher than the unmetered raw flow (see line 11 in FIG. 2). This shows the compressive effect from the known metering process.

This developer compression was hypothesized to have two main causes: 1) Compression due to the skive thickness (parallel to the development roller surface) allows for compression proportional to the skive thickness; and 2) allowing the compression of the extra flow in the metering process, which can influence the compression of the raw flow.

Figure 3A:
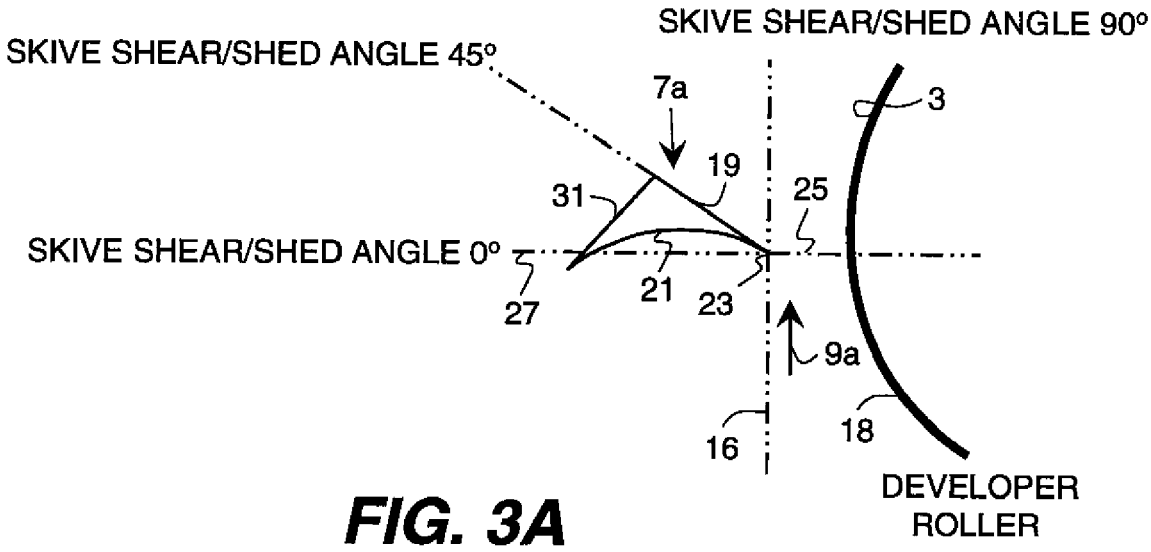
FIG. 3A is a schematic illustration of a metering skive located at a developer-skive interface in accordance with the present invention, wherein the metering skive is at a shearing angle of 45 degrees.
Figure 3B:
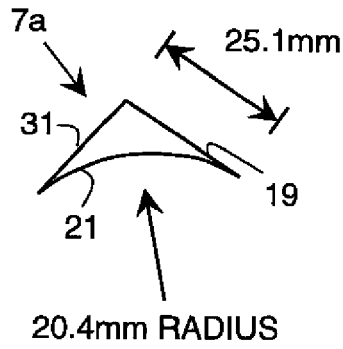
FIG. 3B is an isolated illustration of the metering skive of FIG. 3A.

A feature of the present invention relates to the relationship between metering skive geometry and the amount of developer compression. An embodiment of a metering skive 7*a* in accordance with the present invention is shown in FIGS. 3A and 3B. The metering skive or metering skive assembly is adapted to be mounted on the development system so as to be adjustable and rotatable about a pointed tip or end 23 so as to provide for various shear angles. The rotation of metering skive 7*a* around pointed tip or end 23 can be achieved by various known means; for example, the metering skive 7*a* can be mounted so as to be manually rotatable about pointed tip 23, or the metering skive 7*a* can be mounted so as to be rotatable about pointed tip 23 through the use of mechanical or electromechanical moving means, wherein the rotation can be achieved by way oft for example, a gear train, a chain, a belt, a motor, etc. As shown in FIG. 3A, the shear angle is defined relative to or between a tangent line 16 which is tangent to a surface 18 of the developer roller 3 (or parallel to a line that is tangent to the surface of the developer roller 3 since line 16 is spaced from the surface 18 of the developer roller 3), and a line 27 which is perpendicular to the tangent line 16.

The metering skive in FIGS. 3A and 3B includes a first surface 19 at an exit side of the metering skive 7*a* with respect to a direction of flow 9*a* of the developer onto surface 18 of the developer roller 3. First surface 19 is preferably a substantially straight surface. Metering skive 7*a* further includes a second curved surface 21 at an entrance side of the metering skive with respect to the developer flow direction 9*a* that has a radius of between 15 mm and 30 mm, preferably between 20 mm and 25 mm, and more preferably between around 20.2 mm and 20.4 mm. In a preferred embodiment of the invention, the metering skive 7*a* includes a second substantially straight surface 31, wherein each of the first and second surfaces (19, 31) can have a length of between 10 mm and 30 mm, preferably between 20 mm and 26 mm, and more preferably between 25 mm and 25.1 mm. For illustrative purposes only, FIG. 3B shows an example where the length of first surface 19 is 25.1 mm, and the radius of curved surface 21 is 20.4 mm. Further, the metering skive 7*a* includes pointed tip or end 23 located at developer skive interface 25 about which metering skive 7*a* is rotatable and therefore is adjustable.

Figure 7:
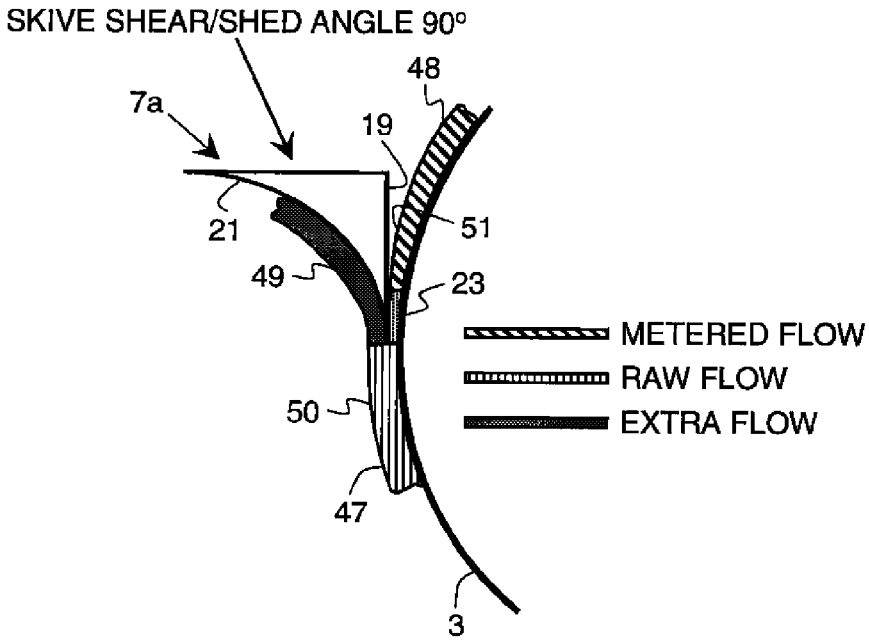
FIG. 7 is a schematic illustration of a metering skive located at a developer-skive interface at 90 degrees, wherein the effect on developer flow is schematically shown.

In a feature of the present invention, metering skive 7*a* is made adjustable so as to permit a control or adjustment of the shear angle. The shear angle is adjusted by rotating the metering skive 7*a* around the pointed tip or end 23 by way of known rotating means which can include manual rotation of the skive and/or rotation through known means such as a motor, a gear train, a belt, a chain, etc. More specifically, the metering skive 7*a* is adjustable between at least a first position where the first surface 19 is perpendicular to tangent line 16 to define a 0 degree shear angle (FIG. 5); a second position where the first surface 19 is at an angle from tangent line 16 to define a 45 degree shear angle (FIGS. 3A and 9); and a third position where the first surface 19 is parallel to tangent line 16 to define a 90 degree shear angle (FIG. 7).

The second curved surface 21 defines a radius which is sized to hold a portion of developer that is sheared from the developer roller surface 18 by the metering skive 7*a*, such that the metering skive 7*a* is adapted to meter the developer flow while minimizing and/or controlling compression of the metered developer on the surface of the developer roller 3.

The angle of the metering skive was made adjustable by allowing the rotation of the whole skive assembly as described above. Within the context of the present invention, the metering skive 7*a* was tested in the three positions noted above of 0°, 45° and 90°. Developer flow was measured and Nap Density or developer bulk density calculated. Measurements included: Raw Flow (No Skiving), Metered Flow=0.75*Raw Flow and Metered Flow=0.25*Raw Flow. The Metering Skive to the Developer Roller gap was adjusted to achieve the desired metered flows. Experimental results are shown graphically in FIGS. 4-9.

Figure 4:
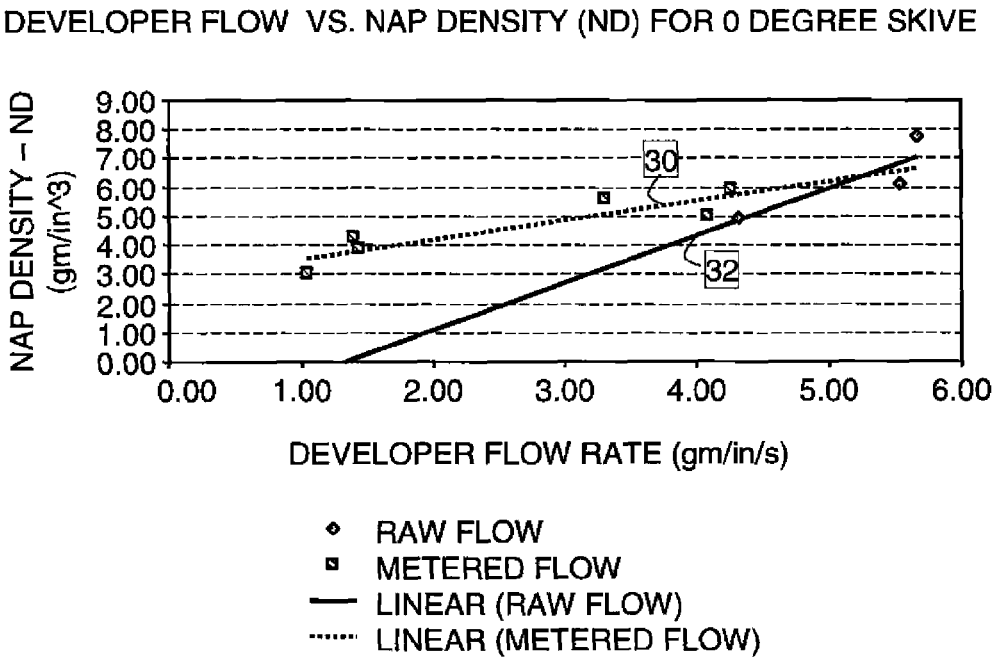
FIG. 4 is a graph of developer flow versus Nap density or developer bulk density for a 0 degree metering skive.

The data shows differences in the developer compression relative to the shear angle of the metering skive. In the graph of FIG. 4 which represents the metering skive 7*a* at a 0 degree shear or skive angle the raw flow before metering is represented by line 30, and the metered flow is represented by line 32. FIG. 4 illustrates the similarity in the relationship between FIG. 2 and the graph of FIG. 4 (0° Shear/Shed Angle). This effect is attributed to the high shed angle at the metering interface 25*a* (FIG. 5) that allows for compression of the raw flow 35 and the extra flow 39 normal to the feed direction, which increases the compression in the metered flow 37.

Figure 5:
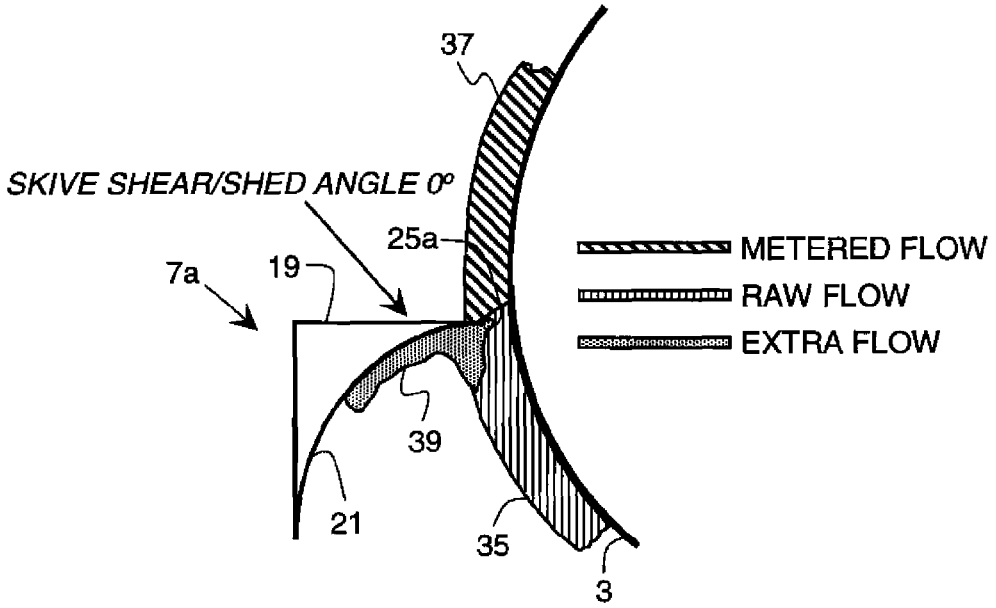
FIG. 5 is a schematic illustration of a metering skive located at a developer-skive interface at 0 degrees, wherein the effect on developer flow is schematically shown.

Accordingly, as shown in FIG. 5, for a 0 degree shear angle, the raw flow 35 is metered at interface 25*a* to provide for metered flow 37 that has the characteristics represented by the graph of FIG. 4. Further, due to the metering skive geometry of the present invention, extra flow 39 that is shed or sheared from the raw flow 35 is captured or held by second curved surface 21.

Figure 6:
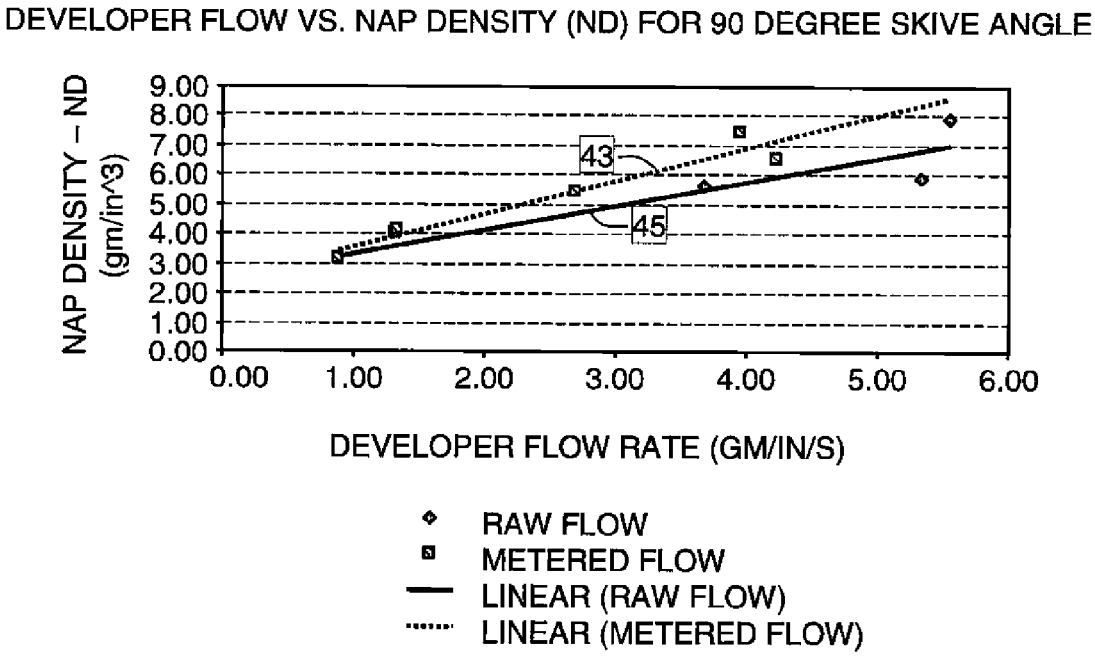
FIG. 6 is a graph of developer flow versus Nap density or developer bulk density for a 90 degree metering skive.

When the shear angle was changed or adjusted to 90° (FIGS. 6 and 7), the shearing action of the shed or sheared portion of the metering skive 7*a* eliminates compression of the raw flow 47 in the pre-metering area 50 (FIG. 7), but the extension of the metering skive 7*a* so that first surface 19 is parallel to the developer flow compresses the developer in the immediate post-metering area 51, resulting in less overall compression than the 0° skive angle (FIG. 6), but still exhibits developer compression. Also note that due to the geometry of metering skive 7*a*, tip portion 23 effectively shears the developer flow to provide for the extra flow 49 which is accommodated at second surface 49, and metered flow 48. The extra 49 flow goes back into the raw feed stream, thereby cycling through the metering zone. The characteristics of the raw flow 47 and metered flow 48 for a 90° shear angle are represented in the graph of FIG. 6 where the raw flow is illustrated by line 45, and the metered flow is illustrated by line 43. As shown in FIG. 7, for a shear angle of 90 degrees, the raw flow 47 is metered to create metered flow 48, while the radius of curved surface 21 enables the capture or holding of extra flow 49.

Figure 8:
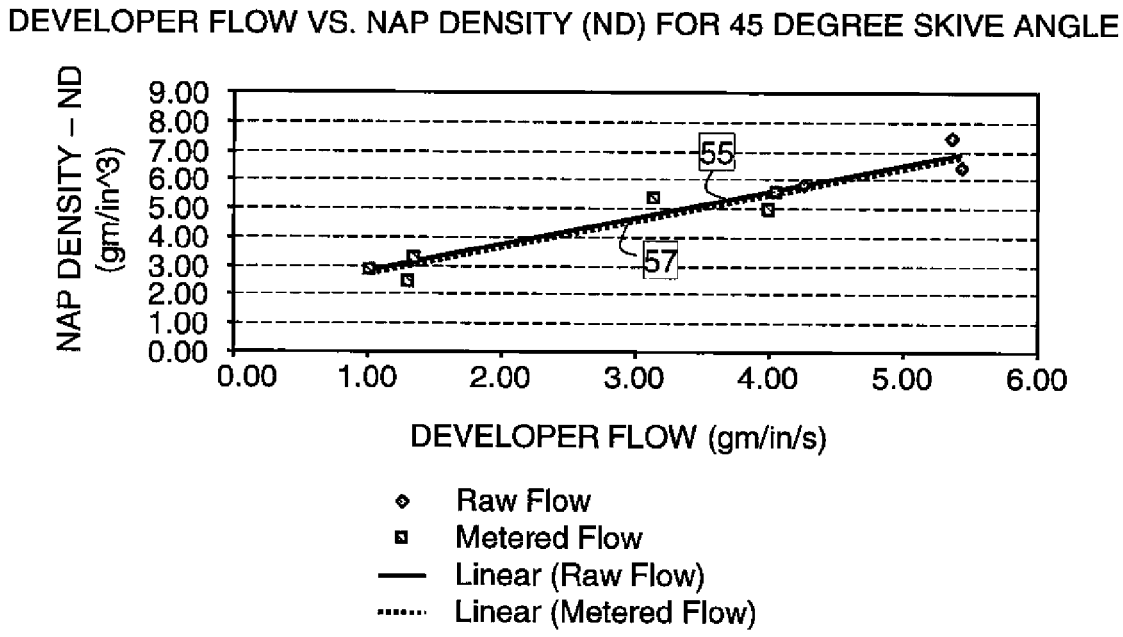
FIG. 8 is a graph of developer flow versus Nap density or developer bulk density for a 45 degree metering skive.
Figure 9:
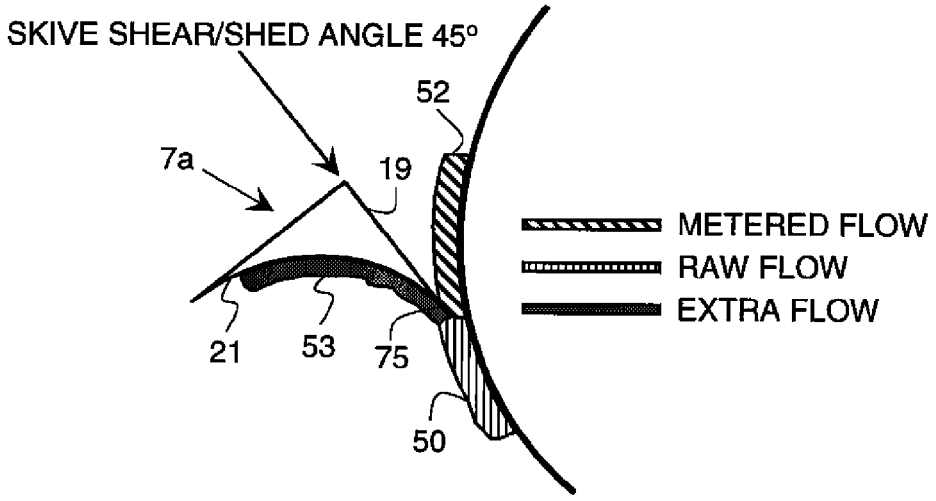
FIG. 9 is a schematic illustration of a metering skive located at a developer-skive interface at 45 degrees, wherein the effect on developer flow is schematically shown.

In a preferred embodiment of the invention the shear angle is adjusted to 45 degrees as shown in FIGS. 8 and 9. When the shear angle is adjusted to 45°, the pre-metering compression is eliminated due to the shearing action of the shed portion of the skive, while the immediate expansion in a post-metering section 75 eliminates post-metering compression, showing the result in the graph of FIG. 8. This shows that there is no compression of the Raw Flow, since the graphs of Nap Density or developer bulk density of the Raw and Metered Flow fall on top of each other. More specifically, as illustrated in FIG. 9, when metering skive 7*a* is at a 45 degree shear angle, the raw flow 50 is metered by metering skive 7*a* to create metered flow 52 and extra flow 53. The extra flow 53 is accommodated at second surface 21 and goes back into the raw feed stream, thereby cycling through the metering zone. In the graph of FIG. 8, the characteristics of metered flow 52 are represented by line 57 and the characteristics of raw flow 50 are represented by line 55. As shown in FIG. 8 and discussed above, with metering skive 7*a* at a 45 degree shear angle, the pre-metering compression is eliminated due to the shearing action of the shed portion of the metering skive, while the immediate expansion in the post-metering section 75 eliminates post-metering compression. This shows that there is no compression of the raw flow, since lines 55 and 57, which respectively represented the raw flow and the metered flow, are basically on top of each other as shown in FIG. 8.

This effect is important because the developer is further compressed in the imaging nip. The developer can be compressed to the point it reaches its maximum bulk density, causing failure, as explained earlier. Reducing metering compression allows more compression (higher developer flow) in the imaging nip, which results in improved image quality.

The invention has been described in detail with particular reference to certain preferred embodiments thereof, but it will be understood that variations and modifications can be effected within the spirit and scope of the invention.

The invention claimed is:

1. A development system comprising:

a developer roller;

a feed roller adapted to supply developer onto a surface of said developer roller; and a metering skive adapted to meter a flow of said developer that is supplied onto the surface of said developer roller, including;

a substantially straight first surface located on an exit side of said metering skive with respect to a direction of developer flow onto the surface of said developer roller; and a curved second surface located on an entrance side of said metering skive with respect to said direction of developer flow onto the surface of the developer roller, said second surface being a curved surface;

wherein the second surface defines a radius of curvature between 15 mm and 30 mm, so that the metering skive shears the developer flow into a metered flow that passes to the developer roller and an extra flow that is shed, held, or captured by the curved second surface.

2. The development system according to claim 1, wherein the radius of the curved second surface is between 20 mm and 25 mm.

3. The development system according to claim 1, wherein the radius of the curved second surface is between 20.2 mm and 20.4 mm.

4. The development system according to claim 1, wherein the first surface is at an angle from a tangent line that extends from the surface of the developer roller to define a shear angle.

5. The development system according to claim 4, wherein the shear angle is 45°.

6. The development system according to claim 4, wherein the developer flow is not compressed by the metering skive.

7. The development system according to claim 4, wherein the shear angle is adjusted to eliminate pre-metering compression.

8. The development system according to claim 4, wherein the shear angle is adjusted to eliminate post-metering compression.

9. The development system according to claim 8, wherein the shear angle is adjusted to eliminate pre-metering compression.

* * * * *